United States Patent [19]

Moens et al.

[11] 4,205,506

[45] Jun. 3, 1980

[54] ENVELOPE OPENING DEVICE AND ENVELOPE STUFFING MACHINE USING SAME

[75] Inventors: Ludo C. M. Moens, Ramsdonk; Raymond G. R. D. Debackere, Edegem, both of Belgium

[73] Assignee: International Standard Electric Corporation, New York, N.Y.

[21] Appl. No.: 931,649

[22] Filed: Aug. 8, 1978

[51] Int. Cl.[2] ..... B65B 43/34

[52] U.S. Cl. ..... 53/569; 53/266 A; 53/384

[58] Field of Search ..... 53/266 A, 385, 570, 53/571, 384, 569

[56] References Cited

U.S. PATENT DOCUMENTS

| | | | |
|---|---|---|---|
| 1,317,387 | 9/1919 | Penney et al. | 53/384 X |
| 1,960,959 | 5/1934 | Sague | 53/266 A X |
| 3,410,053 | 11/1968 | Bonsch | 53/266 A |

*Primary Examiner*—Travis S. McGehee

*Attorney, Agent, or Firm*—John T. O'Halloran; Alfred C. Hill

[57] ABSTRACT

The present device is able to move the walls of an envelope apart from each other when supported by a support having a number of grooves disposed therein. The device includes fingers which when moved into these grooves exert a pressure on a portion of the lower envelope wall covering these grooves, thus moving this portion away from the upper envelope wall and partially opening the entrance opening of the envelope which is afterwards further opened by further movement of the fingers to enable the introduction of documents into the thusly opened envelopes.

11 Claims, 7 Drawing Figures

89
88
60
16
66
59
86
t
T
0
1
2
3
4
5
6
7
8
9
10
11
12
13
14
15
16
17
18
19
20
21

ENVELOPE OPENING DEVICE AND ENVELOPE STUFFING MACHINE USING SAME

BACKGROUND OF THE INVENTION

The present invention relates to an envelope opening device for opening an envelope with an entrance opening defined by a first wall and by a second wall covering said first wall except at least for a portion thereof, said device including a support for said envelope and opening means to move said first and second walls of said envelope apart from one another when carried by said support.

Such an envelope opening device is already known from U.S. Pat. No. 2,325,455. In this known device the opening means to move the first and second walls of an envelope apart from one another include suction members operating on these walls to open the envelope and fingers introduced in the thus opened envelope and engaging the lateral edges thereof to hold the envelope spread lengthwise. A drawback of this known device is the use of suction members because they seriously limit the operation speed of the device.

SUMMARY OF THE INVENTION

An object of the invention is therefore to provide an envelope opening device which does not require the use of such suction members.

According to the invention this object is achieved due to the fact that said support has at least one groove and said opening means include at least one finger able to be introduced into said groove, so that when said envelope is carried by said support with said portion of its first wall covering said groove and when said finger is introduced into said groove, said finger exerts a pressure on said portion which thus moves away from said second wall and partially opens said entrance opening of said envelope.

Another characteristic feature of the present opening device is that it includes blower means to blow air towards said entrance opening of said envelope.

The air thus blown facilitates the opening of the entrance opening of the envelope by the finger.

In accordance with a preferred embodiment of the invention the present envelope opening device includes a horizontal support having three equidistant grooves in its upper surface, a substantially $\pi$-shaped structure with a first longitudinal arm which is parallel to the horizontal support and hingedly connected to a supporting frame and with two parallel first transverse arms, a substantially U-shaped structure with a second longitudinal arm carrying three equidistant L-shaped fingers and with two parallel second transverse arms, the first and second transverse arms being mutually parallel, a control member which is hingedly connected to a bistable coupling mechanism carried by the second longitudinal arm, and pairs of first and second abutments mounted in the path of respective ones of the second transverse arms and adapted to force the bistable coupling mechanism in its first and second position when each of the second transverse arms, under the control of the control member, is moved into contact with the first and second abutment associated to it respectively, all in such a way that when the lower wall of an envelope is positioned on the support and when the control member is operated, with the coupling mechanism in its first position, the ends of the fingers move along an arcuate path and enter corresponding grooves thereby exerting a pressure on the lower wall of the envelope which thus moves away from the upper wall thereof, the coupling mechanism being then brought in the second position wherein the fingers push the upper wall away from the lower one.

The present invention also relates to an envelope stuffing machine for stuffing flat articles into an envelope including an envelope opening device and a device for inserting documents into envelopes previously opened by said opening device.

The present envelope stuffing machine is characterized in that the envelope opening device is as described above.

Another feature of the present envelope stuffing machine is that said document insertion device includes a pocket member for carrying said articles to be stuffed into said envelope, said pocket member having a U-shaped cross-section and comprising a first wall with a cut-out portion at its free edge and a second wall which is much shorter than said first wall, driving means to insert said pocket member carrying said articles into said opened envelope and to remove it therefrom, and pressure means for exerting a pressure on said envelope and on said articles carried by said pocket member and located above said cut-out portion, after said pocket member has been inserted into said envelope so that upon said pocket member being removed from said envelope said articles are withheld in said envelope.

BRIEF DESCRIPTION OF THE DRAWING

The above mentioned and other objects and features of the invention will become more apparent and the invention itself will be best understood by referring to the following description of embodiments taken in conjunction with the accompanying drawings in which.

DESCRIPTION OF THE PREFERRED EMBODIMENT

Principally referring to FIGS. 1 to 6 the envelope stuffing machine shown therein is mounted on a frame including a vertical front plate 1 and bottom plates 2 to 5 and mainly includes an envelope opening device with means to feed envelopes thereto and remove them therefrom and a document insertion device with means to feed documents thereto.

Figure 4:
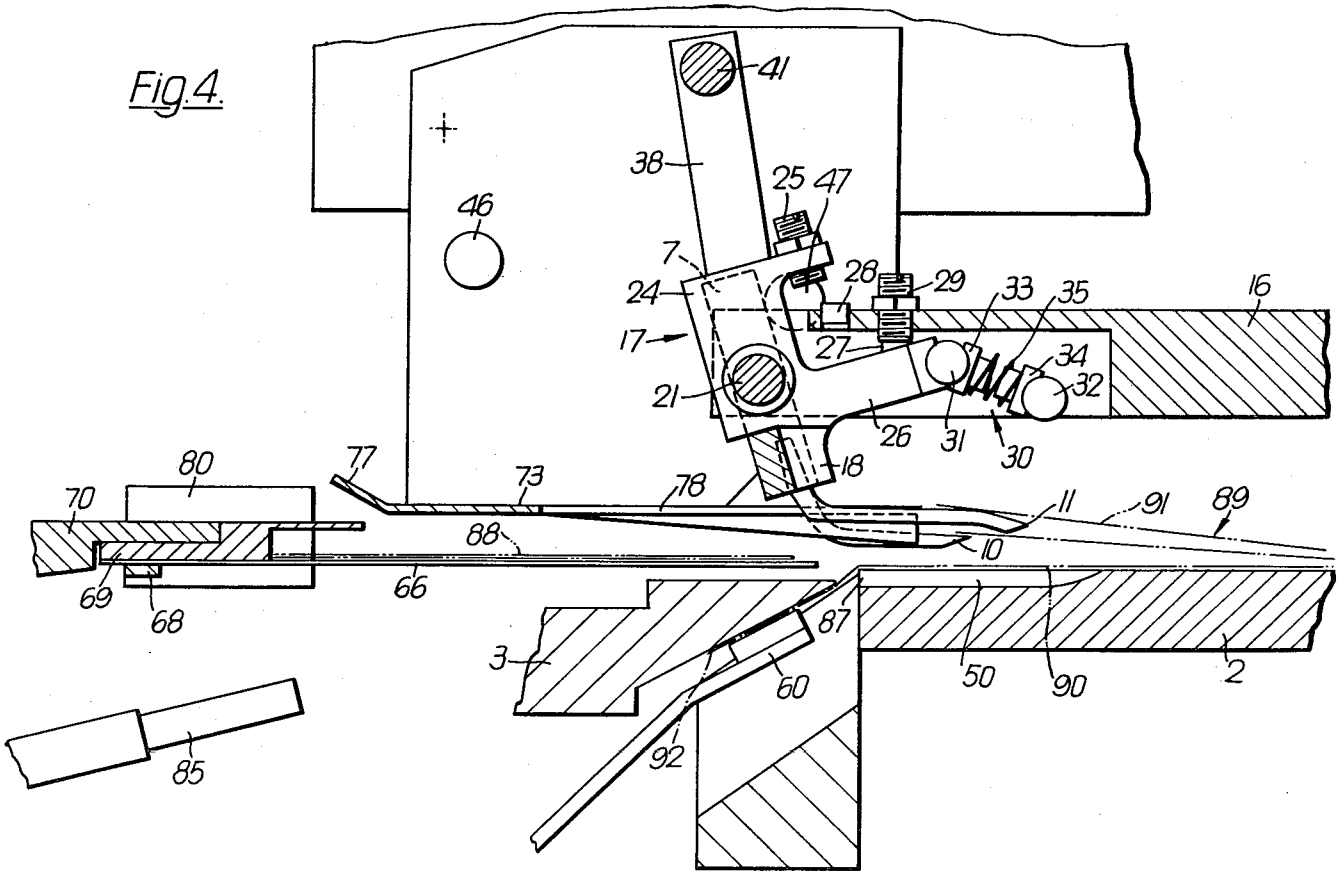
FIG. 4 is a cross-section along line IV-IV of FIG. 3 and viewed in the direction of the arrows, the opening device being in the operative position.
Figure 5:
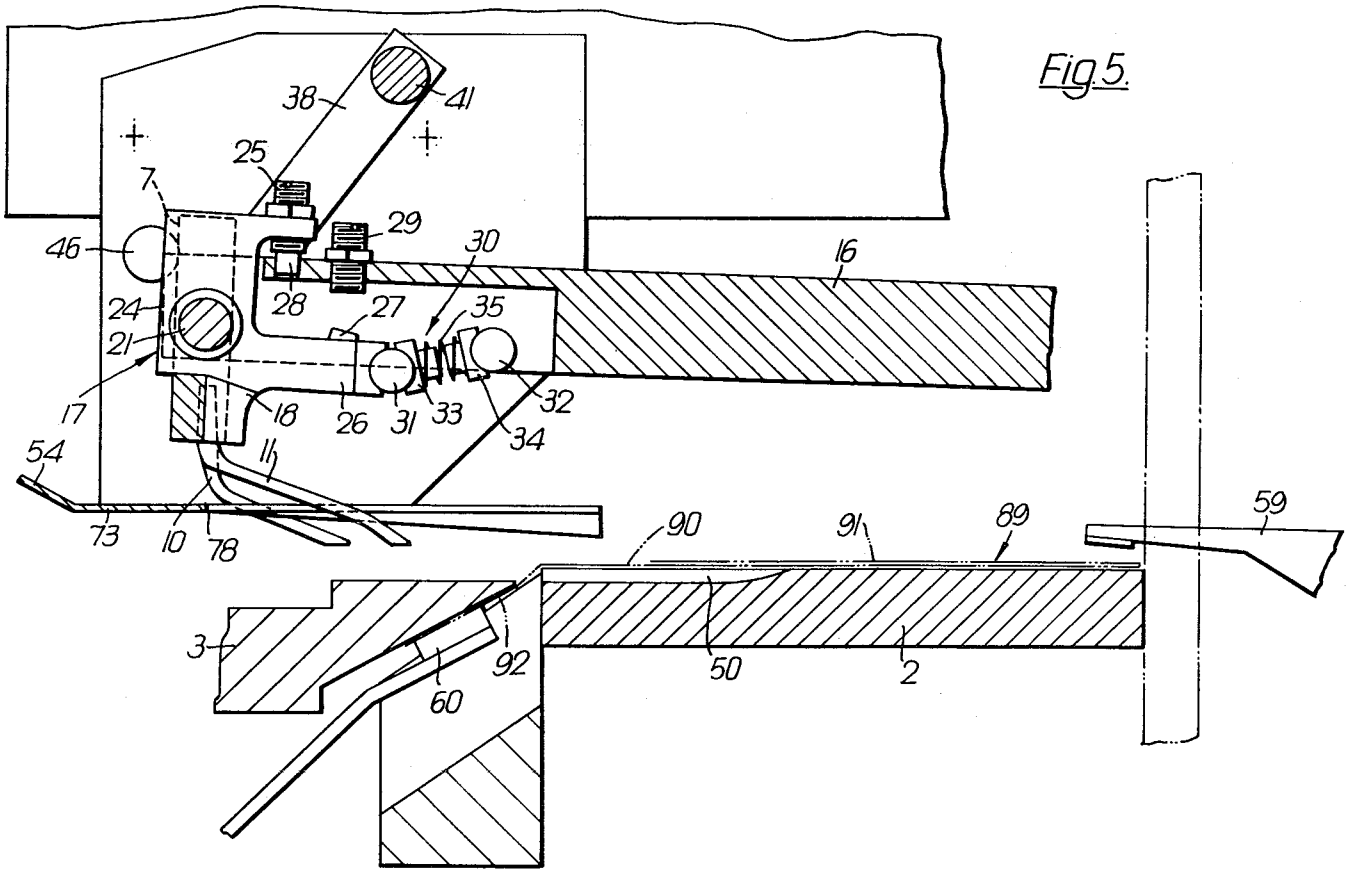
FIG. 5 is a cross-section similar to that of FIG. 4 but with the opening device in the rest position.
Figure 6:
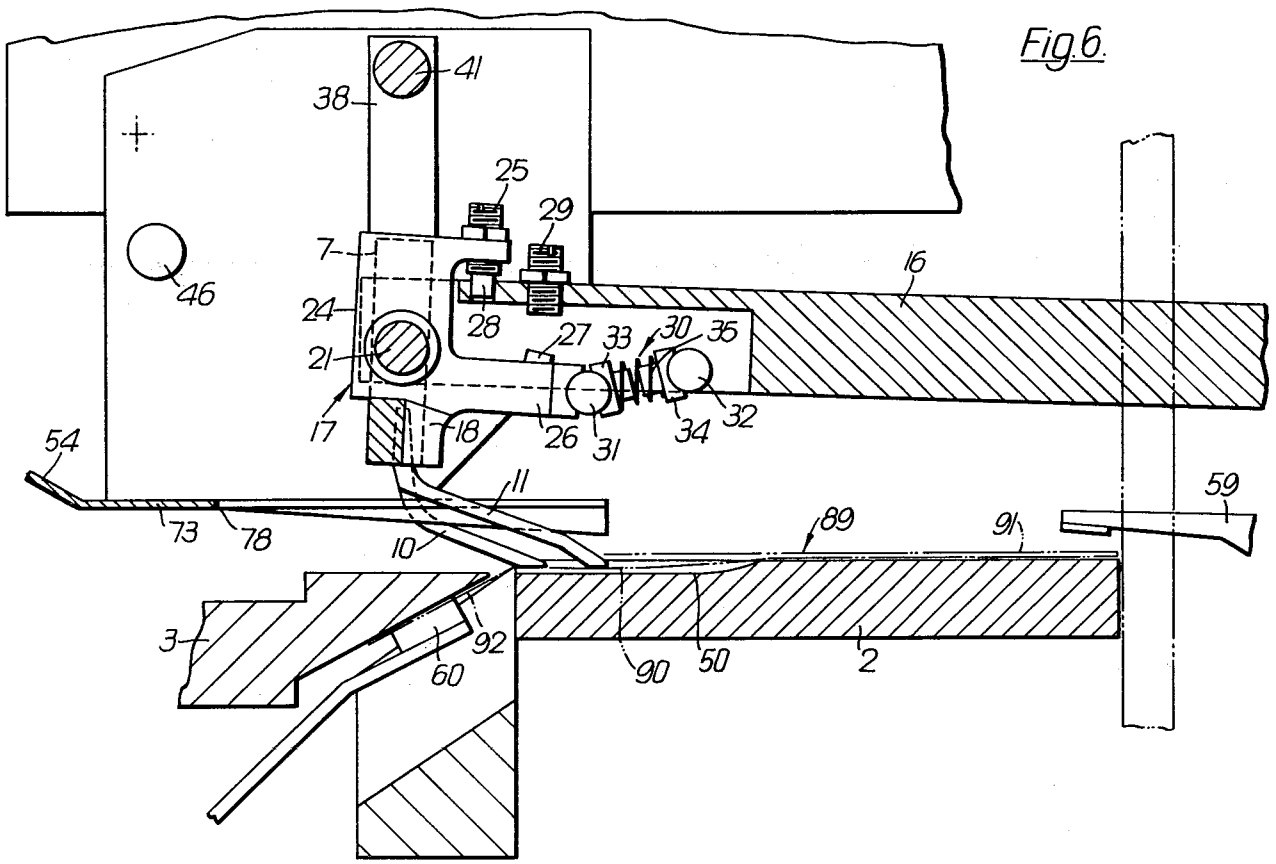
FIG. 6 is a cross-section similar to that of FIG. 4, but with the opening device in an intermediary position.

First the envelope opening device is considered in detail. This device includes a U-shaped structure 6 with lateral arms 7, 8 and a horizontal arm 9 to which three substantially L-shaped fingers 10, 11, 12 are fixed by means of screws 13, 14, 15 respectively. The horizontal arm 9 is hingedly coupled to a control rod 16, able to be displaced to and fro by a not shown mechanism, through the intermediary of a bistable coupling mechanism 17 having a substantially L-shaped cross-section (FIGS. 4, 5, 6). The latter mechanism 17 on the one hand is fixed with its lower portion 18 on the horizontal arm 9 by means of screws 19, 20, while on the other hand it is hingedly connected around a pivot 21 fixed between flanges 22 and 23 of the control rod 16. The L-shaped coupling mechanism 17 has an arm 24 (FIGS. 4, 5, 6) carrying an adjustable abutment 25 and an arm 26 having an abutment 27. The abutment 25 is able to be brought into contact with an abutment 28 on the control rod 16, whilst the abutment 27 is able to be brought into contact with an adjustable abutment 29 on the control rod 16. The arm 26 is coupled with the control rod 16 through two-position locking means 30 comprising a pivot 31 partially located in a recess provided at the end of arm 26, a pivot 32 secured on the rod 16, supporting pieces 33, 34 themselves supported by the pivots 31, 32 and a spring 35 arranged around portions of the pieces 33, 34 and urging pieces 33, 34 and therefore the pivots 31 away from each other.

The arms 7 and 8 of the U-shaped structure 6 are hingedly connected by members 36, 37 to the parallel arms 38, 39 of a $\pi$-shaped supporting structure 40 (FIG. 3) which further comprises a horizontal arm 41 rotatably supported between vertically mounted plates 42 and 43 themselves secured to vertical brackets 44, 45 fixed on the vertical front plate 1. A pair of cylindrical abutments is mounted on each of the supporting plates 42, 43. More particularly abutments 46, 47 (FIG. 4) are fixed on supporting plate 42, while abutment 48 (FIG. 3) and another not shown abutment is secured to supporting plate 43. The ends of the parallel arms 7, 8 are able to move between the abutments of these pairs respectively.

The rounded ends of the above mentioned fingers 10, 11, 12 are able to move in corresponding identical grooves 49, 50, 51 (FIGS. 1, 3) provided in the upper surface of the bottom plate 2. Each of these grooves has a flat bottom wall and diverging side walls. For instance, groove 50 has a flat bottom wall 52 and diverging side walls 53, 54. The upper surface of the bottom plate 2 which is separated from the bottom plate 3 by a slot 87 (FIGS. 1, 4) moreover has grooves 55, 56 (FIGS. 1, 3) with a rectangular cross-section, strips of Nylon 57, 58 being fixed in these grooves 55, 56 respectively.

A pivoted document clamping member 59 (FIGS. 1, 5, 6) extends through an opening in the vertical front plate 1, the free end of this lever 59 being located at a certain distance above the bottom plate 2. A pivoted envelope flap clamping member 60 (FIGS. 4,5,6) is mounted below the lower surface of the bottom plate 3.

An inclined blower pipe 85 (FIG. 4) is mounted at the left of the bottom plate 3.

The means to feed envelopes to the envelope opening device above described are classical and are therefore not shown in detail. There is only represented a blade spring 61 (FIGS. 1, 3) resting on an elevated left hand portion 62 of the bottom plate 2. The means to remove envelopes from the envelope opening device are also well known in the art and are therefore also not represented in detail. Only a conveyor belt 63 (FIG. 1) arranged around freely rotatable rollers 64, 65 is shown, this belt being able to cooperate with not shown driving means mounted above this belt 63. A stop member 86 (FIGS. 1, 3) is mounted between right hand lateral extensions of the bottom plate 2.

Figure 2:
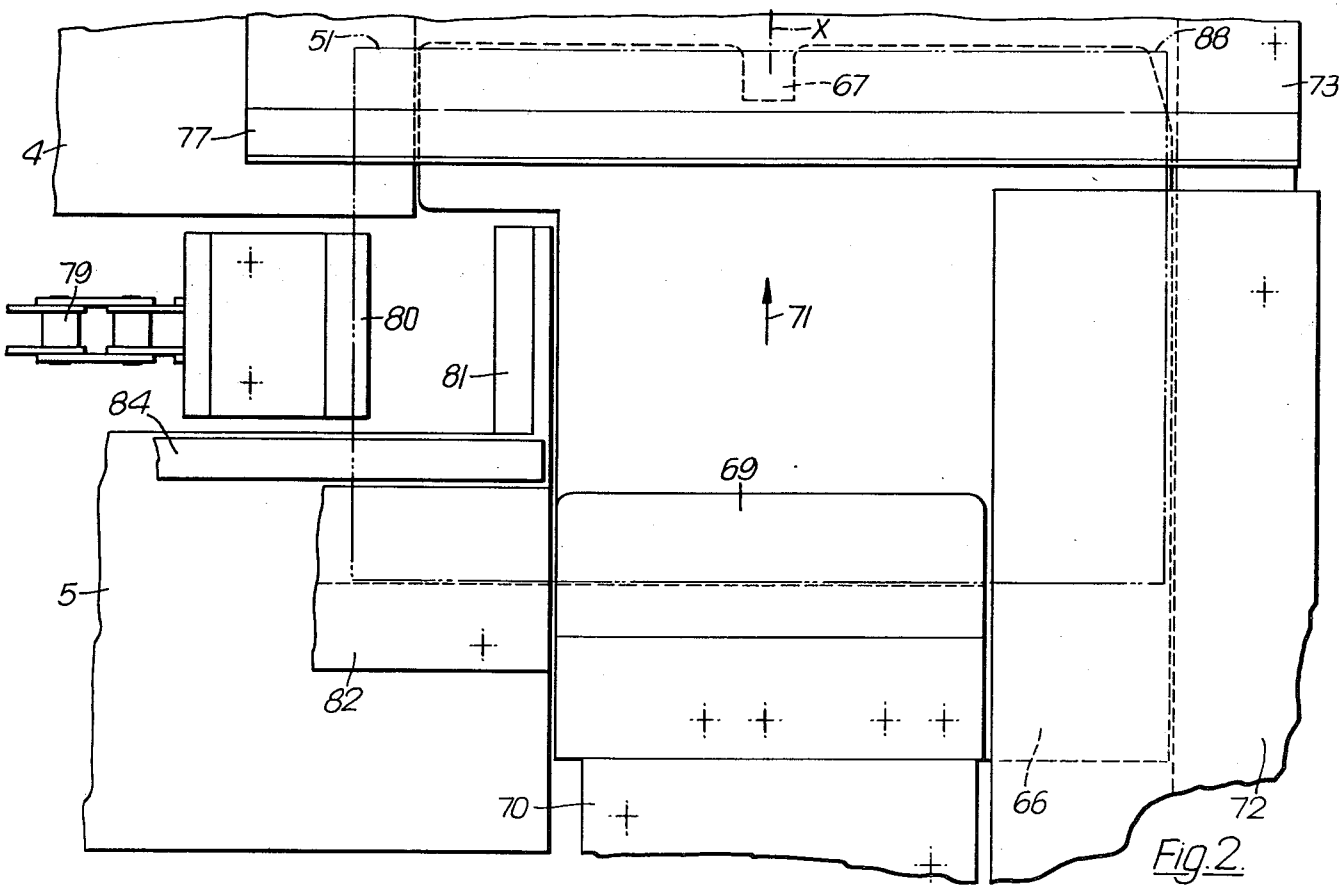
Figure 3:
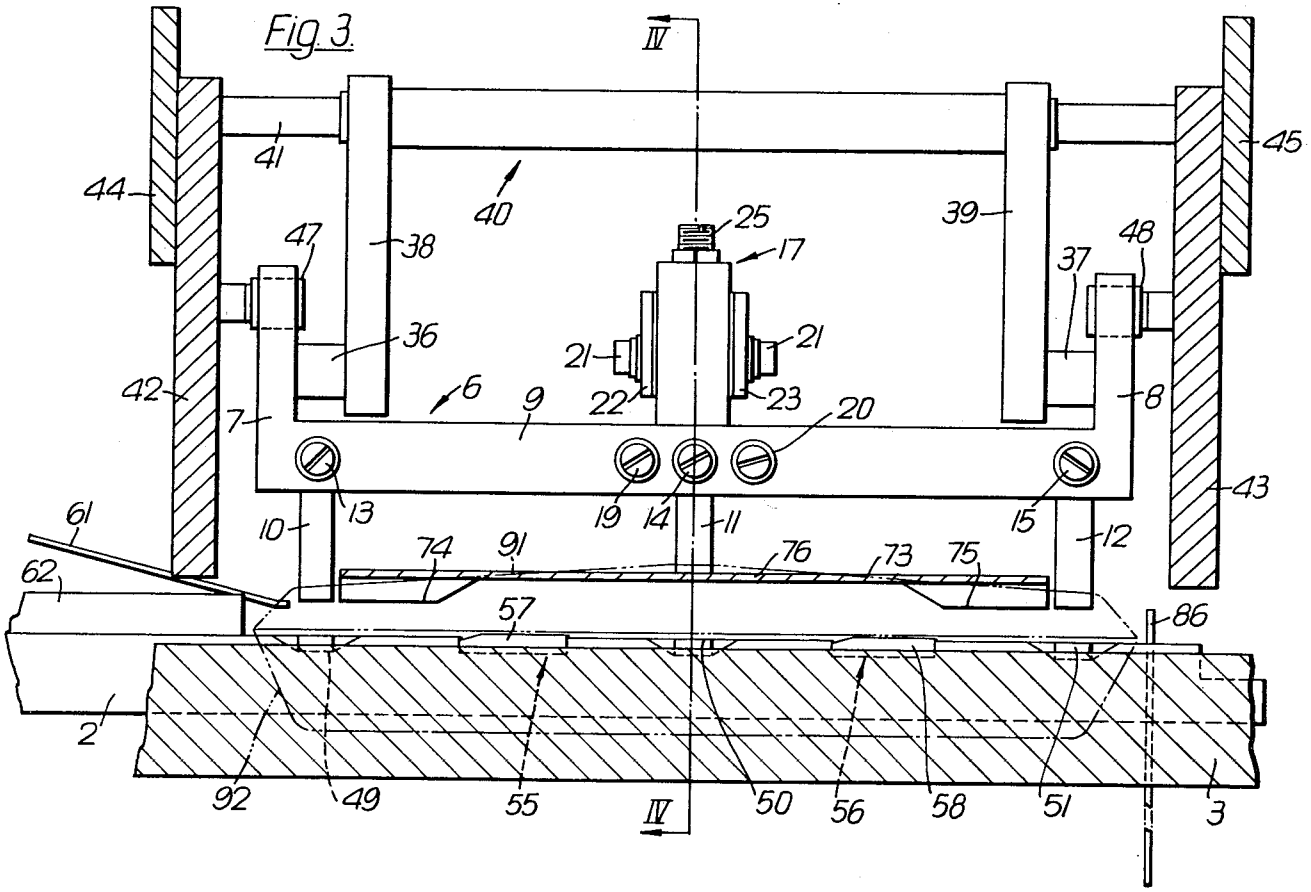
FIG. 3 is a cross-section along line III-III of FIG. 1 and considered in the direction of the arrows.

The document insertion device includes a horizontally mounted supporting plate 66 (FIGS. 2, 4) which has a cut-out portion 67 and which is fixed between a bottom strip 68 and an upper plate 69 on a member 70 which is displaceable to and fro in the direction of arrow 71. The plates 66 and 69 form a pocket member able to contain documents. A guide plate 72 (FIG. 2) having an inclined lower surface (not visible) is mounted at a certain distance above part of the right hand edge of the plate 66. The pocket member 66, 69 is able to be transversely displaced below a horizontal guide plate 73 (partly shown in FIGS. 1 and 2) which is arranged at a certain distance above the edge portion of the bottom plate 2 away from the vertical frame plate 1. The transverse edge portions 74 and 75 of this guide plate 73 are closer to the bottom plate 2 than its centre portion 76 (FIG. 3). Moreover the longitudinal edge portion 77 (FIGS. 2, 4) away from the vertical frame plate 1 is upturned (FIG. 4). The above mentioned fingers 10, 12 are located at both sides of the guide plate 73, while the middle finger 11 protrudes through a slot 78 in this guide plate (FIGS. 5, 6).

The means to feed documents to the document insertion device just considered include a conveyor chain 79 (FIG. 2) carrying Nylon pusher elements 80 able to move in a space defined by bottom plates 4 and 5 and by a lateral extension 81 of the horizontal bottom plate 5. FIG. 2 also shows a strip 82 covering part of the frame plate 5. A blade spring 84 is mounted along the conveyor chain 79 and rests upon the bottom plate 5.

Figure 7:
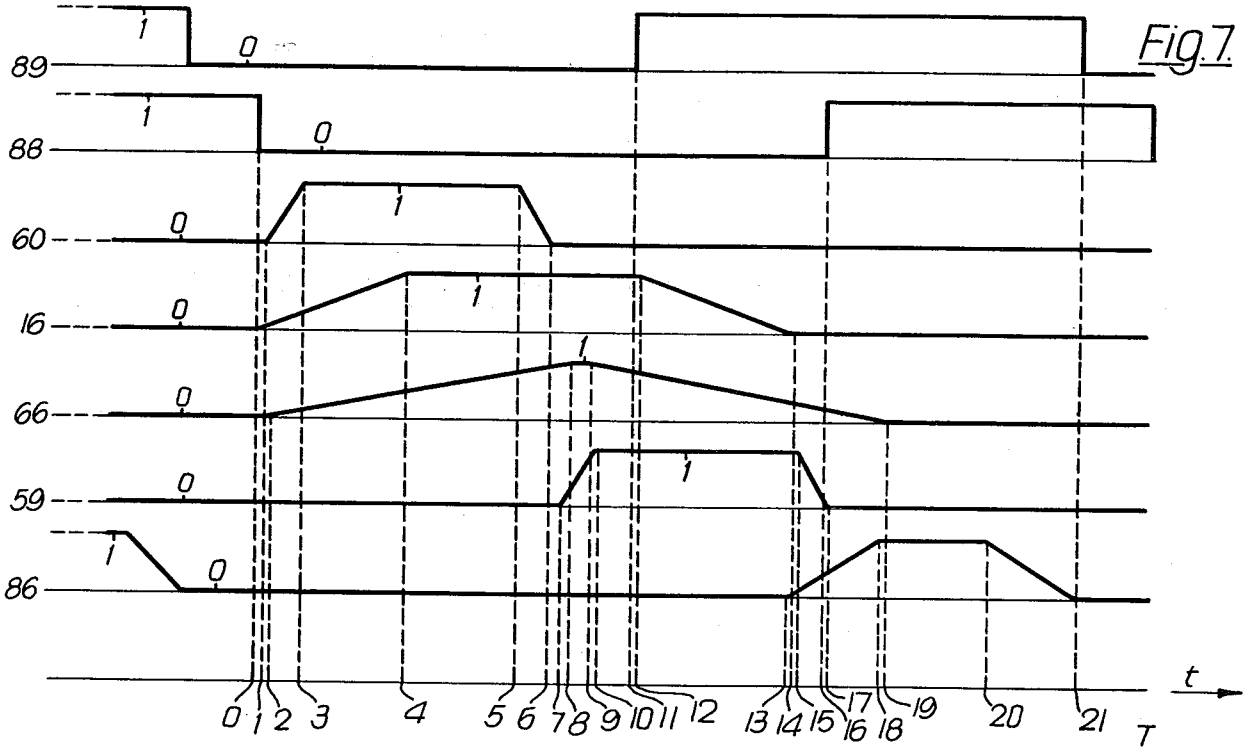
FIG. 7 is a timing diagram of the operation of various parts of the envelope stuffing machine of FIGS. 1 to 6.

Referring now to FIG. 7 the time diagram shown therein represents during a complete cycle and a portion of a preceding cycle:

- in 89 the time intervals during which an envelope such as 89 (FIGS. 1, 4, 5, 6) is being displaced (1-signal) and not being displaced (0-signal) by the envelope feeding means;
- in 88 the time intervals during which a stack of documents such as 88 (FIG. 4) is being displaced (1) and not being displaced (0) by the document feeding means;
- in 60 the time intervals during which the envelope flap clamping member 60 (FIGS. 4, 5, 6) is in the operative (1) and non operative (0) position, inclined portions representing intermediary positions of this member;

in 16 the time intervals during which the envelope opening device of which control rod 16 forms part is being displaced in the operative (1) position and at rest (0) position, inclined portions again representing intermediary positions of this device;

in 66 the time intervals during which the document insertion device of which pocket member 66, 69 forms part is being displaced in the operative (1) position and at rest (0) position, inclined portions representing intermediary transient positions of this device;

- in 59 the time intervals during which the document clamping member 59 is in its operative (1) and non-operative (0) position, inclined portions representing intermediary portions of this member;
- in 86 the time intervals during which the envelope removal means and the stop member 86 are in its operative (1) and non-operative (0) position, inclined portions again representing intermediary positions of these means and member.

By making reference to the drawing an operation cycle T of the above considered envelope stuffing machine is described hereinafter. This cycle time T is for instance equal to 300 ms and during each such cycle an envelope such as 89 may be stuffed with a stack of one or more documents, such as 88, so that a total of 12,000 envelopes may be stuffed per hour.

At the start of the cycle T:

- an envelope 89 is located on the upper surface of the bottom plate 2 and partially below the horizontal guide plate 73, because this envelope has been transferred on this surface during the preceding cycle T1, as shown by 89 on FIG. 7. Hereby the envelope opening device is in the rest position shown in FIG. 5 wherein the lower wall 90 of the envelope 89 having a flap 92 and an upper wall 91 covers the grooves 49, 50, 51 in the upper surface of the bottom plate 2 and wherein the flap 92 of this envelope 89 is located below the bottom plate 3 because it has previously been introduced in the slot 87 between the bottom plates 2, 3;

- a stack of documents 88 is located on the bottom plate 66 of the displaceable pocket member 66, 69 of the document insertion device, because this stack has been transferred on this plate during the preceding cycle T1, as shown by 88 on FIG. 7. Hereby the document insertion device is in the rest position shown in FIG. 2;

- the envelope flap clamping member 60, the envelope opening device, the document insertion device, the document feeding means and the document clamping member 86 all are in their rest position as follows from 60, 16, 66, 59 and 86 on FIG. 7.

It should be noted that, as shown in FIG. 5, the coupling mechanism 17 of the envelope opening device is in one of its stable positions wherein the abutments 25 and 28 of the members 16 and 17 make contact and wherein the arms 7, 8 of the U-shaped structure 6 make contact with the abutments, such as 46, on the frame plates 42 and 43 respectively;

- the blower pipe 85 continuously blows air in the direction of the mouth or entrance opening of the envelope 89, hereby tending to open this mouth.

Figure 1:
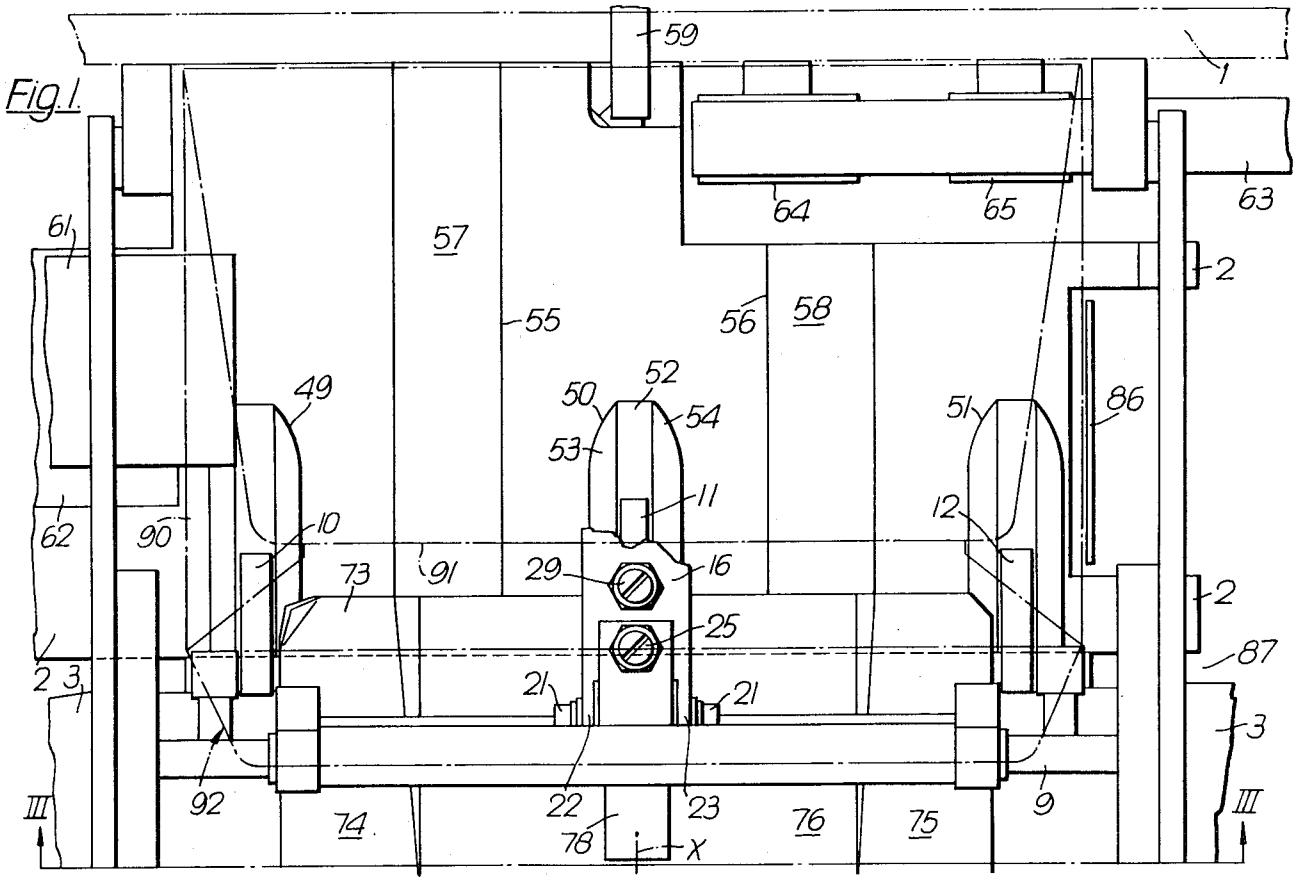
FIGS. 1 and 2, arranged below each other with lines x in alignment, together form a top plan view of an envelope stuffing machine according to the invention. Hereby FIG. 1 mainly represents an envelope opening device with means to feed and remove envelopes to and from this device, while FIG. 2 mainly shows part of a document insertion device with means to feed documents to this device, both devices forming part of the envelope stuffing machine.

The constituent devices of the envelope stuffing machine are then operated as follows during the cycle time T:

- at time $t_o$ the envelope opening device of which control rod 16 forms part starts moving from its rest or non-operative position, represented on FIG. 5 via its intermediary position shown on FIG. 6 towards its end or operative position shown on FIGS. 1, 3 and 4. By the movement of the control rod 16 in the direction of the frame plate 1 the $\pi$-shaped structure 40 is angularly displaced in anti-clockwise direction (FIG. 5) and during this movement the U-shaped structure 6 is likewise angularly displaced to the control rod 16. Consequently the rounded ends of the fingers 10 to 12 fixed on the horizontal arm 9 of the U-shaped structure 6 move along an arcuate path and hereby partially enter the corresponding grooves 49, 50, 51 in the upper surface of the bottom plate 2 (FIG. 6). These fingers first exert a pressure on the portions of the lower wall 90 of the envelope 89 covering these grooves so as to partially open the mouth or entrance opening of this envelope and to facilitate the subsequent introduction therein of the rounded ends of these fingers 10 to 12. During this subsequent movement these ends will be introduced below the upper wall 91 of the envelope 89 (FIG. 4).

- at time t1 the envelope flap clamping member 60 starts operating.

- at time t2 the document insertion device of which pocket member 66, 69 forms part starts moving from its rest or non-operative position represented on FIG. 2 to its end or operative position, an intermediary position being shown in FIG. 4.

- at time t3 the envelope flap clamping member 60 reaches its end position wherein the flap 92 of the envelope 89 is firmly clamped against the inclined bottom surface of frame plate 3 (FIG. 4), so that this envelope 89 cannot be displaced by the fingers 10 to 12 of the envelope opening device when these are introduced in the envelope.

- at time t4 the envelope opening device reaches its end position. Indeed, when the arms 7 and 8 of the U-shaped structure 6 come into contact with the abutments 47, 48 respectively and the control rod 16 continues its displacement these arms 47, 48 and therefore also the horizontal arm 8 and the coupling mechanism 17 fixed thereon are pivoted in anti-clockwise direction into the position shown in FIG. 4. During the latter angular movement first the spring 35 of the locking member 30 is compressed, but once the mechanism 17 has been moved beyond the angular position wherein the arm 26 and the locking means 30 are in alignement the movement of the mechanism 17 is sustained by the spring 35 which is then releasing. Thus the mechanism 17 is brought and maintained in its other stable position wherein the fingers 10 to 12 of the U-shaped structure 6 fully open the mouth of the envelope 89 by lifting the upper wall 91 thereof (FIG. 4) in such a way that the space between this wall 91 and the lower envelope wall 90 permits the subsequent introduction in envelope 89 of the plate 66 of the pocket member 66, 69 and of the stack of documents 88 carried thereon.

- at time t5 the envelope flap clamping member 60 starts releasing.

- at time t6 the envelope flap clamping member 60 no longer clamps the envelope flap 92 against the bottom plate 3.

- at time t7 the document clamping member 59 starts operating.

- at time t8 the bottom plate 66 of the pocket member 66, 69 carrying the documents 88 is introduced into the opened envelope 89 which is thus stuffed.

- at time t9 the pocket member 66, 69 of the document opening device starts withdrawing from the envelope 89.

- at time t10 the document clamping member 59 is fully operative and thus clamps the stack of documents 88 against the bottom plate 2 through the cut-out portion 67 of the plate 66 of the pocket member 66, 69. Thus these documents are maintained in the envelope 89 although the pocket member 68, 69 is being withdrawn therefrom.

- at time t11 the envelope feeding means start operating to feed a new envelope to the envelope opening device.

- at time t12 the envelope opening device starts moving back from its end position in FIGS. 1, 3, 4 to the rest position of FIG. 5. By the movement of the control rod 16 in the direction away from the frame plate 1 the $\pi$-shaped structure 40 is angularly displaced in clockwise direction (FIG. 4) and during this movement the U-shaped structure 6 is likewise angularly displaced.

- at time t13 the driving means (not shown) forming part of the envelope removal means and cooperating with the belt 63 start removing the stuffed envelope 89 from the position shown in FIG. 1 and the stop member 86 starts operating, i.e. starts retracting, to enable the removal of the envelope 89 from the insertion position.

- at time t14 the envelope opening device reaches its end position. Indeed, when the arms 7 and 8 of the U-shaped structure 6 come into contact with the abutments such as 46 and the control rod 16 continues its displacement, these arms and therefore also the horizontal arm 9 of the U-shaped structure and the mechanism 17 fixed thereon are pivoted in clockwise direction into the position shown in FIG. 5. During the latter angular movement first the spring 35 of the locking member 30 is compressed, but once the mechanism 17 has been moved beyond the angular position wherein the arm 26 and the locking means 30 are in alignment, the movement of the member 17 is sustained by the spring 35 which is then releasing. Thus the mechanism 17 is brought in its other stable position.

- at time t15 the document clamping member 59 starts releasing.

- at time t16 the document feeding means start operating to feed a new document to the document insertion device.

- at time t17 the document clamping member 59 is fully released.

- at time t18 the envelope removal means are fully operated and the stop member 86 is fully retracted so that the stuffed envelope 89 can be removed from the inserting position.

- at time t19 the document insertion device reaches its rest position shown in FIG. 2.

- at time t20 the envelope removal means and the stop member 86 start moving to their rest position.

- at time t21 the envelope removal means and the stop member 86 both reach their rest position. Also a new envelope arrives in the inserting position after having been displaced below the blade spring 61 which exerts a vertical pressure on this envelope.

- at time T new documents arrive on plate 66 of the pocket member 66, 69. Prior to attaining this position these document of which the edges rest on the edge portions of the frame plates 4 and 5 are displaced by a pusher element 80 of the conveyor chain 79. Hereby these documents slide below the blade spring 84 and the frame plate 82 and reach the plate 66 of the pocket member 66, 69 via the extension 81 of the frame plate 5. The forward edge of these new documents are prevented from upturning due to the lower surface of the plate 72 being suitably inclined.

It should be pointed out that instead of using an envelope 89 of the type shown, it is possible to use any other type of envelope provided a portion of the first wall is not covered by the second wall since in this way a pressure can be exerted on this portion to open the entrance opening of the envelope.

While the principles of the invention have been described above in connection with specific apparatus, it is to be clearly understood that this description is made only way of example and not as a limitation on the scope of the invention.

We claim:

1. An envelope opening device for opening an envelope with an entrance opening defined by a first wall and by a second wall covering said first wall except for a portion thereof adjacent said entrance opening comprising:

a support for said envelope against which said first wall rests;

at least one groove disposed in said support; and opening means to move said first and second walls apart from one another when said envelope is present on said support, said opening means including at least one finger capable of being moved into said groove, and an arrangement coupled to said finger to move said finger into said groove, when said portion covers said groove, to exert a pressure on said portion to move said first wall away from said second wall and partially open said entrance opening.

2. An envelope opening device according to claim 1, further including blower means disposed adjacent said opening means to blow air toward said entrance opening.

3. An envelope opening device according to claim 1, wherein said arrangement provides a first stable position for said finger, moves said finger from said first position along an arcuate path into said groove to exert said pressure and then moves said finger into a second stable position to completely push said second wall away from said first wall.

4. An envelope opening device according to claim 3, wherein said arrangement includes a supporting frame, a substantially $\pi$-shaped structure having a first longitudinal arm hingedly connected to said supporting frame, and two parallel first transverse arms, and a substantially U-shaped structure having a second longitudinal arm carrying said finger, and two parallel second transverse arms hingedly connected to respective ones of said first transverse arms, said first and second transverse arms being mutually parallel, a control member hingedly connected to a bistable coupling mechanism carried by said second longitudinal arm, and pairs of first and second abutments mounted in the path of respective ones of said second transverse arms and adapted to force said bistable coupling mechanism into said first and second positions when each of said second transverse arms, under control of said control member, is moved into contact with said first and second abutment associated with it.

5. An envelope opening device according to claim 4, wherein said bistable coupling mechanism includes a two-position locking means to couple said bistable coupling mechanism to said control member.

6. An envelope opening device according to claim 1, wherein said finger is substantially L-shaped.

7. An envelope opening device according to claim 1, wherein said support includes at least two of said grooves, and said opening means includes at least two of said fingers each capable of being moved into a different one of said two grooves, said grooves being spaced from each other such that they may be covered by said portion.

8. An envelope opening device according to claim 1, further including clamping means for clamping at least a part of said first wall against said support during the movement of said finger.

9. An envelope opening device according to claim 8, wherein said clamping means operate on a flap of said envelope extending from said first wall.

10. An envelope stuffing machine for stuffing flat articles into an envelope comprising:

a device for inserting documents into envelopes previously opened by said envelope opening device according to claims 1, 2, 3, 4, 5, 6, 7, 8 or 9.

11. An envelope stuffing machine according to claim 10, wherein said document insertion device includes a pocket member for carrying said articles, said pocket member having a U-shaped cross section and comprising a first wall having a cut-out portion at its free edge, and a second wall which is much shorter than said first wall, driving means to insert said pocket member into said opened envelope and to remove said pocket member therefrom, and pressure means disposed above said cut-out portion for exerting pressure on said envelope and on said article after said pocket member has been inserted into said envelope so that upon said pocket member being removed from said envelope said articles are held in said envelope.

* * * * *